United States Patent [19]

Schippers et al.

[11] Patent Number: 4,505,436

[45] Date of Patent: Mar. 19, 1985

[54] YARN WINDING APPARATUS

[75] Inventors: Heinz Schippers; Erich Lenk; Herbert Turk, all of Remscheid; Herbert Schiminski, Hückeswagen, all of Fed. Rep. of Germany

[73] Assignee: Barmag Barmer Maschinenfabrik AG, Remscheid, Fed. Rep. of Germany

[21] Appl. No.: 566,583

[22] Filed: Dec. 29, 1983

[30] Foreign Application Priority Data

| | | | |
|---|---|---|---|
| Jan. 19, 1983 | [DE] | Fed. Rep. of Germany | 3301523 |
| Jan. 28, 1983 | [DE] | Fed. Rep. of Germany | 3302805 |
| Mar. 5, 1983 | [DE] | Fed. Rep. of Germany | 3307915 |
| Mar. 21, 1983 | [DE] | Fed. Rep. of Germany | 3310161 |

[51] Int. Cl.[3] ..... B65H 54/28

[52] U.S. Cl. ..... 242/43 A

[58] Field of Search ..... 242/43 A, 43 R

[56] References Cited

U.S. PATENT DOCUMENTS

| | | | |
|---|---|---|---|
| 3,362,652 | 1/1968 | Butterworth | 242/43 A |
| 3,374,961 | 3/1968 | Otsuka et al. | 242/43 A |
| 3,650,486 | 3/1972 | Hasegawa et al. | 242/43 A |

FOREIGN PATENT DOCUMENTS

| | | | |
|---|---|---|---|
| 396207 | 5/1924 | Fed. Rep. of Germany | 242/43 A |
| 396776 | 6/1924 | Fed. Rep. of Germany | 242/43 A |
| 679838 | 8/1939 | Fed. Rep. of Germany | 242/43 A |
| 690941 | 5/1940 | Fed. Rep. of Germany | 242/43 A |
| 1710068 | 10/1971 | Fed. Rep. of Germany | 242/43 A |
| 3001953 | 8/1980 | Fed. Rep. of Germany | 242/43 A |
| 29054 | of 1911 | United Kingdom | 242/43 A |
| 1168893 | 10/1969 | United Kingdom | 242/43 A |

*Primary Examiner*—Stanley N. Gilreath

*Attorney, Agent, or Firm*—Bell, Seltzer, Park & Gibson

[57] ABSTRACT

A yarn winding apparatus is disclosed which is characterized by the ability to wind a plurality of running yarns onto a corresponding number of bobbins mounted on a common support spindle, and wherein the bobbins may be closely spaced apart to thereby permit the required length of the support spindle to be minimized. The apparatus comprises a plurality of side by side traversing assemblies extending along the length of the support spindle, with each traversing assembly comprising a yarn guide bar and a pair of oppositely rotating rotors. The rotors include arms which define two closely adjacent planes of rotation, and the two rotors of each assembly are mounted for rotation about offset axes and so that the arms sweep across the guide bar in opposite directions to define the traverse stroke. The rotors of adjacent traversing assemblies are mounted so that the planes of rotation of the arms of the two rotors are respectively coincident, with the circles defined by the rotating arms in each plane overlapping each other. Also, the corresponding axes of adjacent traversing assemblies are offset in opposite directions.

39 Claims, 18 Drawing Figures

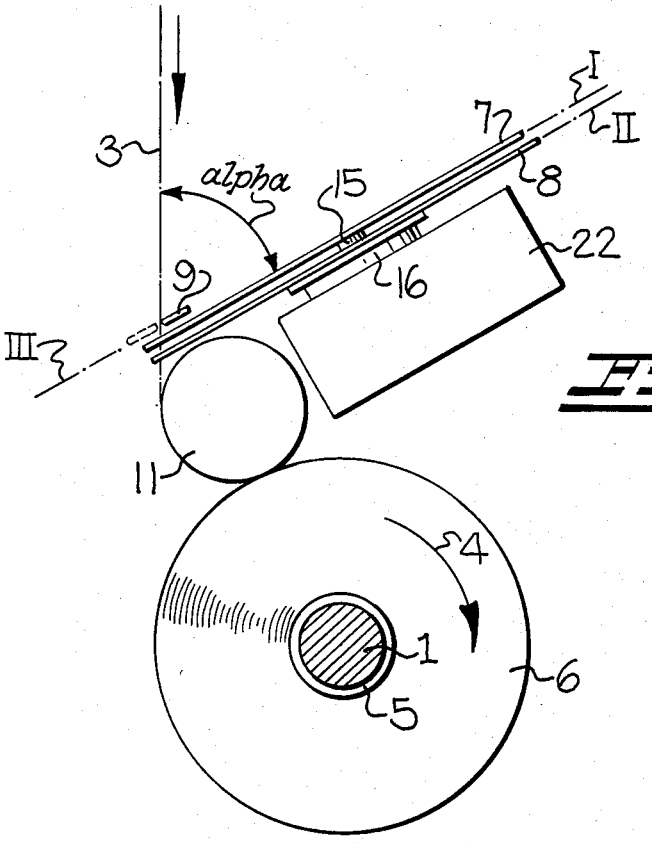
Fig-2
Fig-3
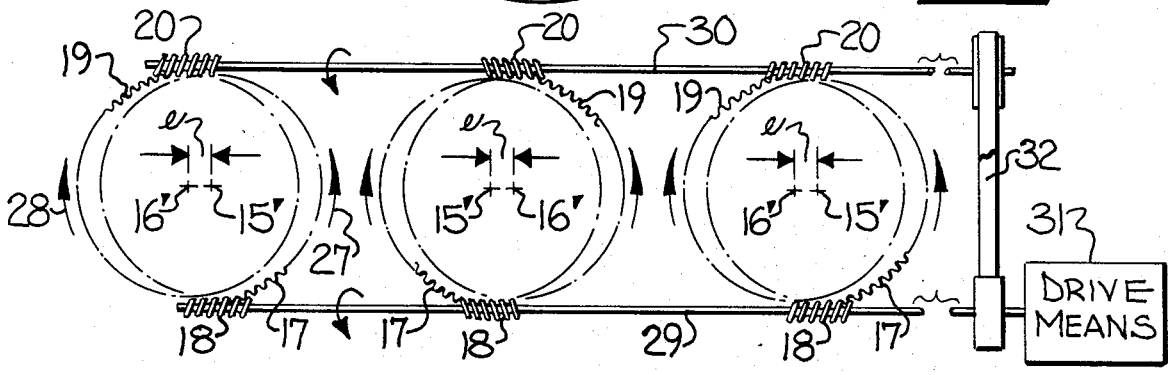
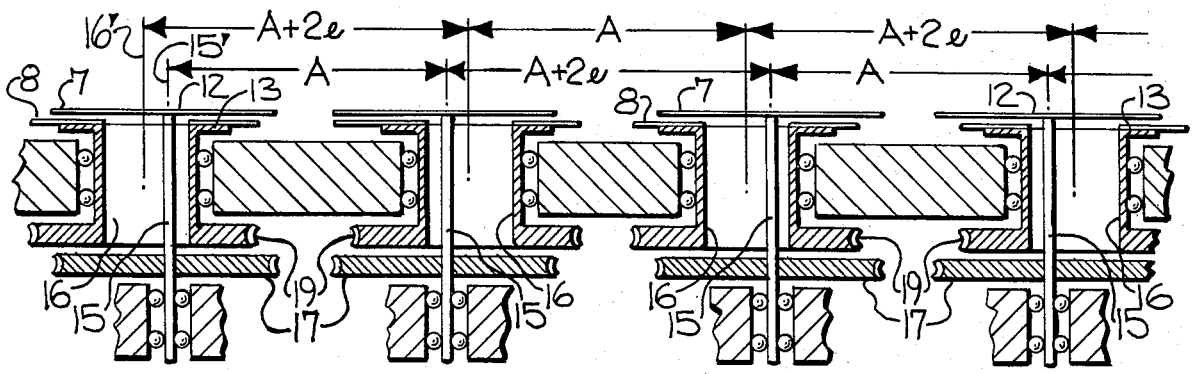
Fig-4

YARN WINDING APPARATUS

The present invention relates to a yarn winding apparatus for winding a plurality of running yarns to form a corresponding number of yarn packages. The winding apparatus is particularly adapted for winding continuously running yarns, such as synthetic yarns which are continuously delivered and wound into packages at speeds exceeding 6000 m/minute.

A winding apparatus is disclosed in German Pat. No. 15 60 469 and corresponding British Pat. No. 1,168,893 which comprises two yarn guide blades which are mounted for rotation in opposite directions about parallel offset axes, with the axes being positioned so that the ends of the blades alternately sweep over a yarn guide to reciprocate the yarn along a traverse stroke and so as to form a cross wound package.

It is an object of the present invention to provide a winding apparatus of the above general type, and which is suited for simultaneously winding a plurality of yarns, and more particularly, for winding a plurality of yarns which are delivered along parallel paths of travel to a plurality of closely spaced apart winding stations.

It is a more particular object of the present invention to provide a yarn winding apparatus which has the ability to wind a plurality of running yarns onto a corresponding number of yarn carrier tubes, commonly termed bobbins, which are mounted on a common support spindle, and wherein the bobbins may be closely spaced apart on the support spindle to thereby permit the required length of the support spindle to be minimized.

These and other objects and advantages of the present invention are achieved in the embodiments illustrated herein by the provision of a winding apparatus which comprises bobbin support means for mounting a plurality of tubular bobbins in a coaxial, closely spaced apart arrangement, and a plurality of traversing assemblies disposed in a closely spaced apart arrangement extending along the bobbin support means. Each of the traversing assemblies comprises a yarn guide bar mounted to extend in a direction generally parallel to the axis of the bobbin support means, a first rotor having at least two coplanar radial arms and mounted for rotation about a first axis, and a second rotor also having at least two coplanar radial arms and mounted for rotation about a second axis, with the two axes being parallel to and offset from each other in a direction generally parallel to the axis of the bobbin support means. Also, the two rotors are positioned so that the arms thereof define respective first and second planes which are parallel to and closely adjacent each other, and the axes of the rotors are positioned such that the extremities of the arms pass along the yarn guide bar upon rotation thereof.

In accordance with the present invention, the traversing assemblies are mounted adjacent to each other such that each traversing assembly has its first axis offset from its second axis in a direction which is opposite to the direction of offset in each immediately adjacent traversing assembly. Also, the first and second planes of the assemblies are respectively coincident, and the extremities of the rotor arms of adjacent traversing assemblies define circles upon rotation thereof which overlap in at least one of the first and second planes. The winding apparatus further includes drive means for rotating the rotors of each traversing assembly in opposite directions with respect to each other, and for rotating the rotors of adjacent traversing assemblies so that the first rotors thereof rototate in opposite directions with respect to each other, and the second rotors thereof rotate in opposite directions with respect to each other.

The above described winding apparatus permits the traverse strokes to be arranged in a parallel and closely spaced arrangement, and so that the bobbins may be mounted on a common mounting spindle with the ends of the bobbins abutting each other, or lying so close to each other that the wound yarn can cover almost the entire length of each bobbin, and so that there remains only a short distance on each end, one of which may be covered by the formation of a waste winding and/or a transfer tail. This construction permits the bobbin support spindle to be relatively short for a given number of packages, thereby reducing the required cantilevered length of the spindle and also reducing the overall machine dimensions. By reason of the fact that all of the arms of the rotors are arranged in only two planes of rotation, the distance between the arms is as small as possible, and the distance between the planes of rotation of the arms and the point at which the yarn runs onto an underlying guide roll is also small. This is a necessary condition for the precise winding of the yarn onto the bobbin according to a winding law which ensures an accurate build of a package which permits optimum drawing of the yarn from the bobbin.

By reason of the fact that the rotors of adjacent traversing assemblies have their rotating arms in common planes of rotation, and are driven in opposite directions, the circles of rotation of the adjacent rotors may overlap each other to the greatest possible extent, without the arms contacting or otherwise obstructing each other. The construction of alternately offsetting the first and second axes of adjacent traversing assemblies also serves to minimize the required axial separation of the packages. To explain this advantage, it will be understood that the adjacent ends of the guide bars of adjacent assemblies will cooperate with radial arms which lie in the same plane to traverse the yarn toward the center of the stroke. By mounting the rotors for these arms closer together in the described manner, the guide bars and thus the packages may be brought axially together to the maximum extent.

The fact that the axial distance between those rotors of adjacent traversing assemblies which have arms rotating in a common plane, is different from the distance between the rotors having their arms rotating in the other plane of rotation, permits the drive means to be arranged in a simple manner, and also permits simultaneous traversing movements for all of the yarns and so that all of the yarns move together simultaneously in their back and forth traverse motion.

In a preferred embodiment, each of the traversing assemblies includes a guide roll positioned immediately adjacent the yarn guide bar, or the planes of rotation of the rotors, depending upon their sequence in the direction of the running yarn. Also, the guide rolls of the several traversing assemblies are preferably axially aligned. The bobbins may be selectively positioned, so long as it is ensured that the trailing yarn length between the guide roll and the point at which the yarn runs onto the bobbin is short, and is substantially identical from bobbin to bobbin. When these conditions are met, the bobbins may be clamped onto a single support spindle, and a uniform build of the packages may be achieved. The bobbins may be in circumferential contact with the guide rolls, or they may be positioned at a small distance thereform.

The individual bobbins may alternatively be clamped onto individual support spindles, with the build of the packages being different. Further, conical cross-wound packages may be formed, with a surface line contacting the guide roll or positioned parallel thereto. In accordance with the present invention, this embodiment may permit two or three or more traverse strokes in one yarn winding arrangement.

A particularly advantageous relationship of the length of traverse stroke and the distance between the individual traverse strokes is achieved when each rotor is provided with three arms which are equally spaced by 120 degrees. Also, the arms of adjacent traversing assemblies which are arranged in common planes of rotation mesh in the overlap zone, with the arms moving through the overlap zone in the same direction and their phase relationships being displaced in an essentially symmetrical manner.

The extremities of the arms are preferably provided with a trailing edge, sometimes termed a "braking flag", which is positioned on the side of the arm which is opposite the edge which contacts the yarn. This braking flag is configured such that the point where the arm covers the guide bar moves toward the center of the traverse stroke at essentially the traversing speed. Stated in other words, the trailing edge cooperates with the guide bar in engaging the yarn after the yarn has reached the end of the traverse stroke and so as to permit the yarn to move along the trailing edge and guide bar from the end of the traverse stroke toward the center thereof at a controlled speed. The possibility that the yarn may move toward the center of the traverse stroke at a higher speed than provided by the speed of the leading edge, is thereby avoided.

At the beginning and at the end of the winding process, the yarn should be removed from the traversing assembly. For this purpose, the guide bar may be arranged on the side of the yarn running plane on which the drive means for driving the rotors is also located. Further, the guide bar may be withdrawn from the rotor axes until the guide bar is no longer covered by the arms. This embodiment offers the advantageous possibility of providing the guide bar with a yarn catching notch which is positioned at each end portion of the guide bar which extends beyond the traverse stroke. When the guide bar is withdrawn from the area where it is covered by the blades, the yarn slides into the yarn guiding notch.

The guide bar of the present invention may also serve as a yarn guiding member which, for example, may carry the running yarn into a yarn catching zone and/or a yarn reserve zone of the bobbin. Further, it is proposed that the guide bar may serve as a guide means at least in special areas. For this purpose, the guide bar may be composed of an inner and an outer guide rail, so that the yarn cannot be removed from the guide bar. It is particularly advantageous to arrange these rails at the ends of the traverse stoke, if the yarn is to be reciprocated according to a reciprocation pattern with increased accelerations and/or decelerations.

By shaping the contour of the guide bar, the advantageous possibility is provided of achieving certain stroke patterns for the yarn, such as causing the traversing speed of the yarn to be reduced in the center of the stroke so that an accumulation of yarn windings at the center may be achieved which is for example 2% higher than the yarn windings accumulated in the end portions of the traverse stroke. It is also possible that both the guide rails of the guide bar be contoured in a different manner and that the trailing edges of the arms be designed such that the trailing edges control the yarn along one guide rail when moving forward and along the other guide rail when moving backward.

Where the guide bar is positioned on the side of the yarn path where the drive means for the rotors is also located, it is possible to protect the arms on the yarn handling side of the yarn path, by a protective cover plate. Such plate may extend in the yarn running direction beyond the planes of rotation, and the plate may be fixed at one end of the traverse stroke and extend parallel to the stroke. At the other end of the traverse stroke, the plate may include a yarn inserting slot directed into the plane of the yarn run. By this arrangement, it is ensured that injuries to personnel caused by the rotating arms may be avoided, and also that the arms cannot be damaged during handling of the yarn, such as by a suction pistol which is used to guide the yarn during thread up.

The yarn inserting slot preferably cooperates with a generally known arrangement for forming a yarn reserve, by which the yarn is caught and carried into the area of the traverse stroke, where it is released so that it may be caught by the rotating arms.

As noted above, the so-called yarn trailing length between the operative edges of the arms and the point where the yarn contacts the bobbin, should be small. This trailing length may be considerably shortened by positioning a yarn guide roll between the planes of rotation of the arms and the bobbin, with the roll being covered without being contacted by the leading edges of the arms sweeping thereacross. The diameter of the guide roll is relatively small, so that the point where the yarn contacts the guide roll is located very closely below the lower plane of rotation. This distance may essentially equal the radius of the guide roll. Another preferred possibility for reducing the yarn trailing length includes inclining the traversing assemblies in such a manner that the planes of rotation of the arms and the planes of the yarn run form an angle which ranges between about 45 degrees and 70 degrees. The yarn trailing length between the rotating planes of the arms and the point where the yarn contacts the guide roll may thus be shortened such that it is less than the radius of the guide roll.

Where the drive means for rotating the rotors is mounted on the side of the planes of rotation which is opposite from the bobbins, additional space is provided for arranging drive rolls between the planes of rotation and the bobbins. Such drive rolls preferebly circumferentially contact the bobbins and are driven at a constant speed.

Preferably, the yarn moves from the guide roll to the bobbin substantially without forming a trailing length. In order to avoid any trailing length between the guide roll and the bobbin, the guide roll may be arranged so as to contact the circumference of the bobbin. To this effect, the guide roll is preferably supported by a spring biasing arrangement which permits the guide roll to follow the contour of the rotating package in the event the surface is noncircular. A drive roll may also be provided which is suspended by the same spring biasing arrangement. It is thereby provided that both the guide roll and the drive roll withdraw from the axis of the bobbin support spindle during the build of the package.

Further, the drive roll may also serve to provide for an increase in the distance between the support spindle axis and the traversing apparatus, while the package builds. For this purpose, the drive roll, the guide roll, and the traversing assembly may be mounted on a common carriage, with the guide roll being movable with respect to the carriage by means of springs, and the drive means of the carriage being controlled as a function of the deflection of the guide roll caused by the build of the package.

In those embodiments where the gears as well as the other portions of the drive means for the rotors are positioned on the side of the planes of rotation adjacent the support spindle, it is easy to maintain the traversing device, and in particular to remove unintended windings of filaments on the rotors or parts thereof. Also, in such cases it is not necessary that the gears of the rotors be dismounted if the rotors need to be removed.

In those embodiments where the gears and related drive means of the rotors are positioned on one side of the planes of rotation, one rotor may include a first rotatably mounted shaft, and the other rotor may include a tubular second shaft which receives the first shaft eccentrically therethrough. The two shafts may be driven by separate drives, for example by belts or gear wheels. In view of the fact that it is important that the rotational speeds of the rotors be controlled very precisely with respect to each other, so that an exact transfer of the yarn from one to the other arm may be ensured, it is preferred that the first and second shafts be drivingly connected to each other by a transmission shaft mounted inside of the tubular second shaft. This permits the tubular shaft and the first shaft to rotate at precisely the same speed, but in opposite directions and with a precise phase relationship.

The above embodiment also offers the advantageous possibility of providing a casing for each traversing assembly, which houses and supports the shafts of the two rotors. Each casing is designed so that it may be removed and reinstalled for maintainance purposes, independently of the casings of the other traversing assemblies. Also, the phase relationship of the rotors with respect to each other may be precisely adjusted during final assembly at the manufacturing plant. Further, in such instance, only one of the shafts, and preferably the tubular shaft, is driven from the outside, for example by a drive belt, a gear wheel, a worm gear drive, or the like.

In another embodiment of the invention, the gear drive for the rotors having arms which rotate in the upper plane of rotation, viewed in the direction of the yarn run, are positioned above such plane, and the gear drive for the rotors having arms which rotate in the lower plane of rotation are positioned below such lower plane. In this instance, the housing for the drives is preferably divided into two housing components, so that the upper housing component may be removed, or swung away, from the lower housing component. Removal of the arms and other components is thus facilitated.

Another advantageous driving means for the rotors of the several traversing assemblies includes a pair of drive rods extending along the assemblies in a direction parallel to the bobbin support spindle. One rod drives the rotors of one plane of rotation, and the other rod drives the rotors of the other plane of rotation. In one embodiment, a worm drive is associated with the individual rotors, with the thread direction of the worms alternating from lefthanded to righthanded from traversing assembly to traversing assembly.

In still another embodiment, the rotors of one plane of rotation may be driven by one tangential belt which loops around pulleys on the rotors alternately in a counterclockwise and then a clockwise direction. Alternatively, all of the rotors rotating in one plane of rotation may be driven through bevel gears by a common drive rod which extends along all of the traversing assemblies. The bevel gears are positioned from assembly to assembly alternately on the left and right sides of the rotors. The rotors rotating in the other plane of rotation may be driven by a similar bevel gear driving arrangement. However, such other rotors may also be driven by their associated rotors via intermediate gear wheels, in such a way that the rotors of a traversing assembly rotate at the same speed, but in opposite directions, with the proper phase relationships being insured for a precise transfer of the yarn at the ends of the traverse stroke.

Some of the objects and advantages of the invention having been stated, others will appear as the description proceeds, when taken in connection with the accompanying generally schematic drawings, in which FIG. 1 is a fragmentary top plan view of four traversing assemblies of a winding apparatus embodying the present invention, and illustrating the rotors and guide bars of each assembly;

FIG. 2 is a sectional end view of the winding apparatus;

FIG. 3 is a schematic illustration of a gear drive system for the traversing assemblies;

FIG. 4 is a schematic sectional view through the traversing assemblies taken in the plane of the rotor axes;

FIGS. 14 and 15 are end sectional views illustrating two additional embodiments of the present invention;

Figure 1:
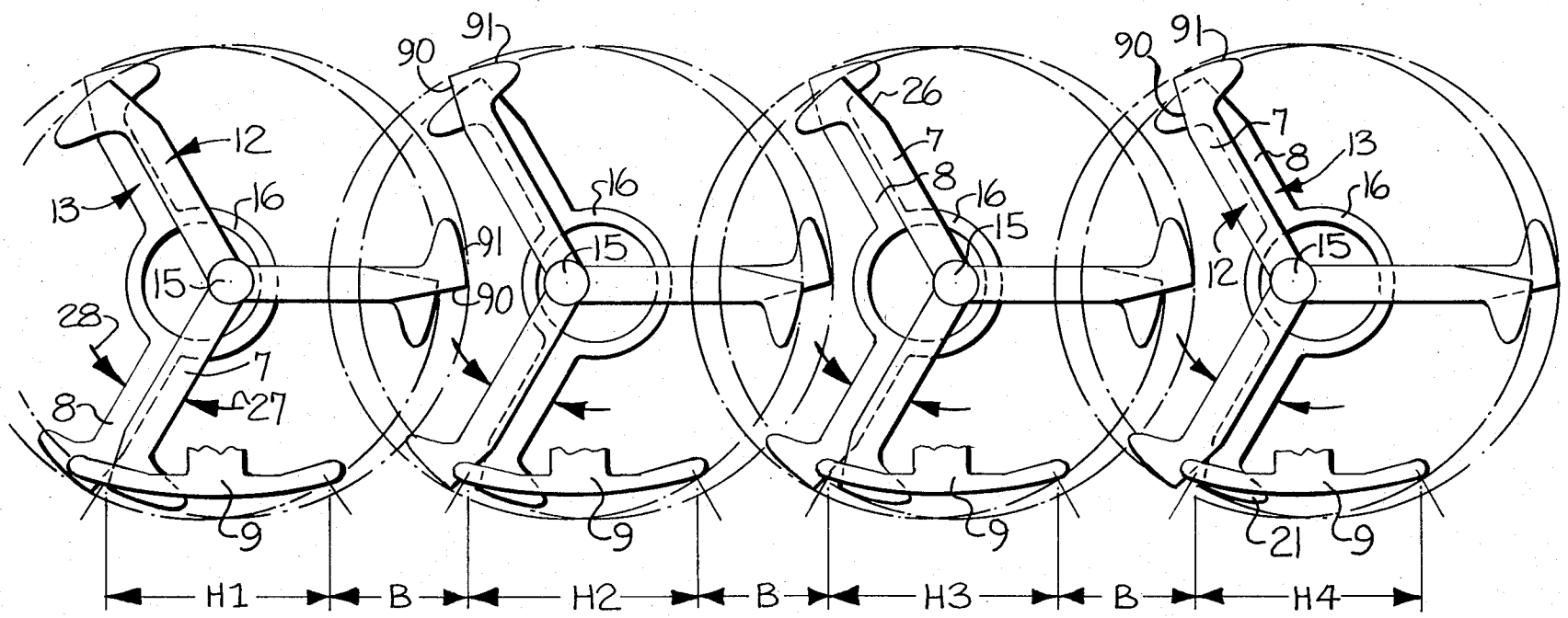
FIG. 1A is a front elevation view of the four traversing assemblies of FIG. 1.

Referring more particularly to the drawings, FIGS. 1, 1A, and 2 illustrate a winding apparatus embodying the features of the present invention, and which is adapted for winding a plurality of running yarns 3 to form a corresponding number of yarn packages. The apparatus comprises a support spindle 1 for mounting a plurality of tubular bobbins 5 in a coaxial arrangement, and yarn traverse means for reciprocating the running yarns 3 along respective aligned traverse strokes and so as to form a wound yarn package 6 on each bobbin 5. The yarn traverse means comprises a plurality of traversing assemblies 2 disposed in a closely spaced apart arrangement extending along the bobbin support spindle 1, with each traversing assembly being adapted to reciprocate one running yarn 3 onto a rotating bobbin 5 mounted on the support spindle. In FIG. 1A, the position of the yarn at each end of the traverse stroke is indicated by the dashed lines 3'.

The bobbin support spindle 1 is driven in the rotational direction 4 by a motor (not shown) which is operatively connected to the spindle. The spindle mounts four bobbins 5 in the illustrated embodiment, which are coaxially aligned and abut each other, with the package on the inner or right end of the shaft as seen in FIG. 1A also abutting a collar on the shaft. During the winding period, i.e. the period during which a package is being formed, and which is identical for all bobbins 5, a cross-wound package 6 will be formed on each bobbin from one yarn 3, with the yarns being delivered from a direction perpendicular to the bobbins. Depending on the type of bobbin support spindle used, from about three to eight yarns running parallel with respect to each other may be supplied to the spindle for being wound into packages 6, with the number of packages corresponding to the number of yarns.

Each traversing assembly 2 comprises a yarn guide bar 9 mounted to extend in a direction generally parallel to the axis of the support spindle 1. Further, each assembly 2 comprises a pair of rotors 12, 13, with the rotor 12 comprising three coplaner radial arms 7, and a mounting shaft 15 which is mounted for rotation about the axis 15' (note FIG. 3) and such that the extremities of the rotating arms pass along the yarn guide bar 9 and define a first plane I. The second rotor 13 also includes three coplaner radial arms 8, and a tubular mounting shaft 16 which is mounted for rotation about the axis 16' such that the extremities of the rotating arms pass along the yarn guide 9 and define a second plane II. The first axis 15' is parallel to and offset from the second axis 16' in a direction generally parallel to the axis of the support spindle 1, and the first and second planes I and II are parallel to and closely adjacent each other.

According to the present invention, each traversing assembly 2 has its axis 15' offset from its second axis 16' in a direction which is opposite to the direction of offset in each immediately adjacent traversing assembly. Thus as illustrated in FIG. 3, the eccentricity e of the rotors associated with a particular traversing assembly is opposite to that of the rotors associated with the adjacent assemblies, so that the axial distance between corresponding rotors varies from traverse stroke to traverse stroke. Specifically, the axial distance between the rotors of one plane of rotation, for example plane I, is different from the axial distance between the associated rotors of the plane of rotation II within two adjacent traverse strokes. If the smaller axial distance is termed "A", the greater distance is "A+2e", note FIG. 4.

The traversing assemblies are also mounted so that the first and second planes of rotation of all of the assemblies are respectively coincident, so that the arms of all of the rotors 12 lie in the plane I, and the arms of all of the rotors 13 lie in the plane II. Further, the traversing assemblies are mounted such that the extremities of the rotor arms of adjacent traversing assemblies define circles upon rotation thereof which overlap in at least one of the first and second planes, and preferably both of such planes.

In the embodiment of FIGS. 1, 1A, and 2, the guide bar 9 is positioned above the planes I and II, and on the same side of the running yarn plane as are the shafts 15 and 16. It should be noted however that the guide bar 9 alternatively may be positioned on the other side of the running yarn plane, as indicated in dashed lines in FIG. 2. As also seen in FIG. 2, the planes of rotation I and II and the plane III of the guide bar 9 are all inclined in such a manner that the planes form an angle alpha with respect to the plane of the running yarn of between about 45 degrees and 70 degrees. This arrangement permits a guide roll 11 to be positioned at a very small distance below the plane of rotation II, and so that the yarn will be partially looped about the guide roll 11 and is guided to the package 6. The guide roll 11 may be in circumferential contact with the package as illustrated in FIG. 2, or it may be positioned at a small distance from the package and rotatably driven.

Referring now to the embodiment of FIGS. 3 and 4, it will be seen that the shaft 15 of the rotor 12 is rotatably driven by worm gear wheel 17 and worm 18. The hollow shaft 16 of rotor 13 is positioned so that its axis 16' is parallel to and offset from the axis 15' of shaft 15, with the eccentricity being indicated at e. Each hollow shaft 16 is driven by a worm gear 19 and worm 20. The worms 18 are mounted on the drive rod 29 which extends in a direction parallel to the axis of spindle 1, and the worms 20 are mounted on the parallel drive rod 30. The rods 29 and 30 are rotatably driven in the same direction by the motor 31 and toothed belt drive 32. The worms 18, 20 of one traversing assembly have the same thread direction, and the thread direction of the worms varies from traversing assembly to traversing assembly, being alternately lefthanded and righthanded. The rotors of each assembly are thereby driven in opposite directions, at the same speed, and with a predetermined phase relationship.

As noted above, each rotor 12 and 13 has three arms 7, 8, which are equally spaced with respect to each other at an angle of 120 degrees. The two rotors 12, 13 of each traversing assembly form one traverse stroke H, which extends along the length of the guide bar 9. The traverse stroke H covers a sector angle of about 60 degrees.

Where several traversing assemblies are arranged side by side as illustrated, it is proposed by the present invention that the circles defined by the extremities of the rotor arms 7, which are positioned in the plane I, and the circles of the arms 8 which are positioned in the plane II, overlap to the greatest possible extent, and that the arms of two adjacent assemblies mesh within this overlap zone while rotating in opposite directions. Accordingly, the arms are arranged and driven such that the arms 7 of the plane I or the arms 8 of the plane II move in the same direction within the overlap zone and follow each other with a symmetrical phase shift of 60 degrees. The symmetrical phase relationship of adjacent assemblies is illustrated by the instantaneous view of the arms in FIG. 1. As shown, the rotor 12 and shaft 15 of the assembly for the first traverse stroke H1 rotate in a clockwise direction 27. Thus the arms 7 of the rotor 12 convey the yarn to the left as shown. Further, the rotor 13 and hollow shaft 16 rotate in a counterclockwise direction 28, and the arms 8 of the rotor 13 convey the yarn to the right. FIG. 1 also shows the yarn at the moment it is transferred from an arm 7 to an arm 8.

Figure 5:
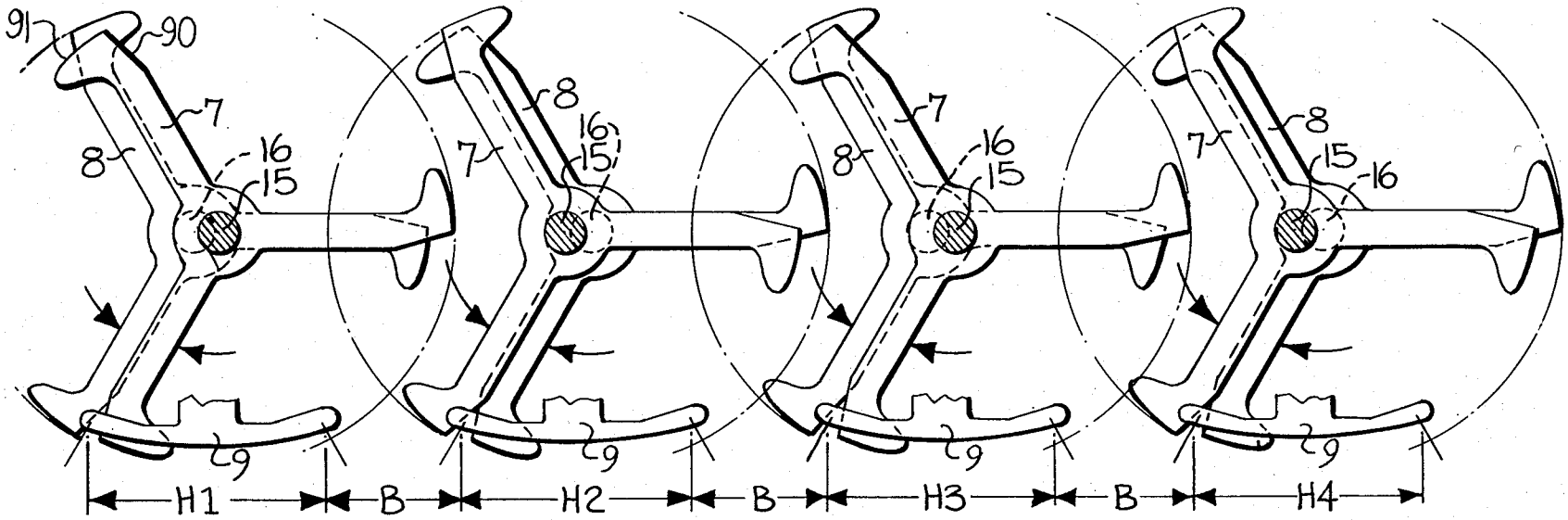
FIG. 5 is a view similar to FIG. 1, but illustrating a second embodiment of the invention.
Figure 7:
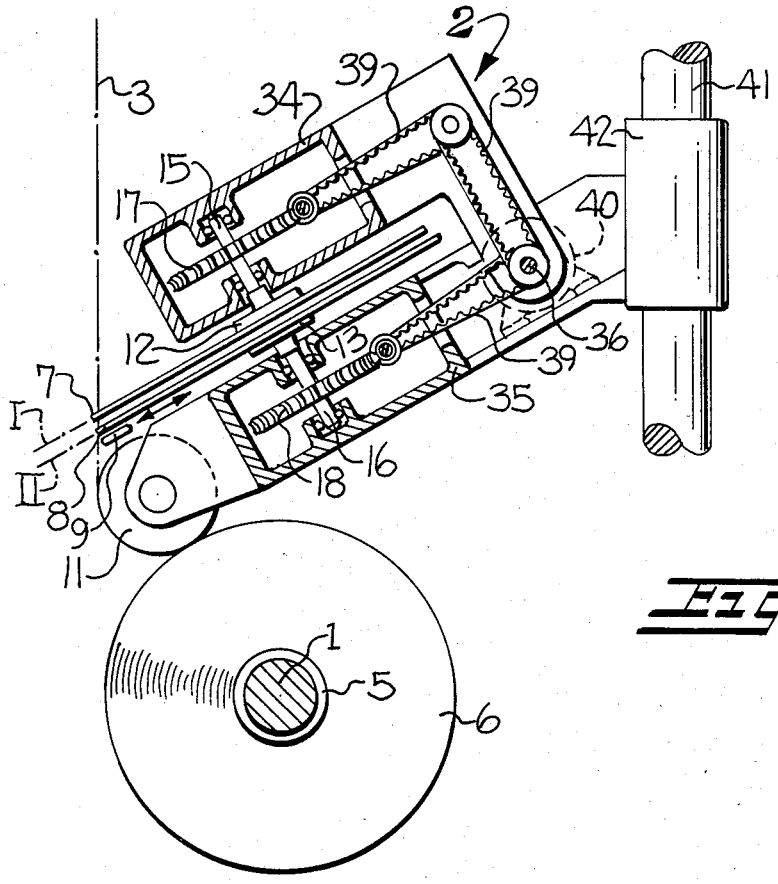
FIG. 7 is a sectional end view of the embodiment of the invention shown in FIG. 5.

In the embodiment shown in FIGS. 5 and 7, the rotors 12 and 13 are supported on shafts 15 and 16 respectively, which extend in opposite directions and thus lie on opposite sides of the planes of rotation I and II. The shafts 15 and 16 mount respective worm gear wheels 17, 18, and the gear wheels are drivingly connected to each other by a toothed belt drive 39, which in turn is driven by a motor 40. The shafts 15 and 16 are rotatably mounted in housing components 34 and 35, which are connected to each other along the motor axis by a hinge 36, so that the housing component 34 may be lifted away from the component 35. It thus becomes easier to maintain the arms, and particularly to clean the arms of yarn windings and fragments, if necessary. The housing components 34 and 35 are supported by a carriage 42, which in turn is movably mounted on a support rod 41 such that the traversing assembly is able to withdraw upwardly as the packages 6 build in diameter. To this effect, appropriate drive and control means may be provided by which the pressure of the guide roll 11 on the package 6 is readjusted in accordance with a predetermined value, and the movement of the traversing assembly is controlled. For a further disclosure of a control system of this type, reference is made to German Pat. No. 25 32 164 and U.S. Pat. No. 4,106,710.

The top plan view of the embodiment shown in FIG. 5 illustrates again that the axial distance between the shafts 15, the arms 7 of which rotate in the plane I, is relatively small between traverse stroke H1 to stroke H2, while it is greater between stroke H2 and stroke H3. To the opposite effect, the axial distance between the shafts 16, the arms 8 of which rotate in the plane of rotation II, is relatively large between traverse stroke H1 and stroke H2, while it is relatively small from traverse stroke H2 to traverse stroke H3. The eccentricity of the shafts 15, 16 is thereby reversed in direction from traverse stroke to traverse stroke. Also, the rotors of adjacent traversing assemblies are rotated so that the rotors 15 rotate in opposite directions with respect to each other, and the rotors 16 thereof also rotate in opposite directions with respect to each other. In FIG. 5, which shows an instaneous position of the rotors, the arms are meshing like toothed wheels within the overlap zone, so that there is a phase shifting of about 60 degrees between the arms 7 of the traverse stroke H1 and the arms 7 of the traverse stroke H2. The same relationship applies to the arms 8 in these and the other traverse assemblies.

Figure 6:
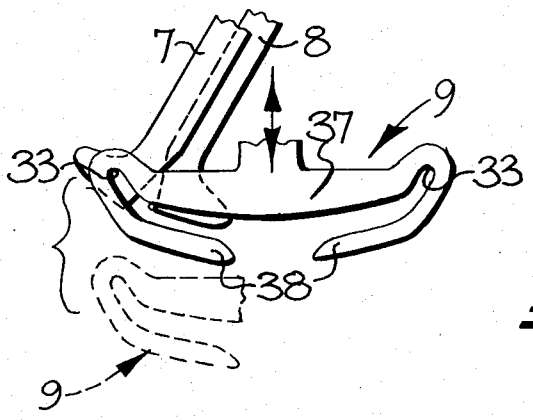
FIG. 6 is a fragmentary plan view of one embodiment of the guide bar adapted for use with the present invention.

FIG. 6 illustrates a specific embodiment of the guide bar 9, which is particularly adapted for use where the guide bar is located on the same side of the yarn traverse plane as are the traversing assemblies. In this case, the guide bar is composed of a continuous inner guide rail 37 and an outer guide rail 38 extending generally parallel to and spaced from the inner guide rail along each end portion thereof to thereby provide opposing yarn guide edges along each end portion, and so as to define a yarn catching notch 33 therebetween. The inner guide rail 37 may also be curved in a direction such that the traversing speed is greater at each of the end portions of the traverse stroke than the average traverse speed by about 1 to 4%, to obtain more accumulation of yarn windings at the center than at the end portions. Also, the guide bar may be mounted so that it may be withdrawn from the rotors as illustrated in dashed lines and the arrow in FIG. 6. In so doing, the yarn is moved away from the circle of rotation of the arms and the yarn passes to one side of the traverse stroke and slides into one of the yarn catching notches 13. It is then possible to catch the yarn and, for example, remove it by suction in order to change the bobbins. In addition, it is also possible to guide the yarn at the beginning of the winding process into the yarn catching notch and to cause the guide bar 9 to perform traverse movements for catching the yarn on the tube and/or for forming a transfer tail.

By reason of the overlapping of the circles of rotation of the arms of adjacent yarn traversing assemblies, and due to the arrangement of the rotors with varying eccentricities and rotational directions as described above, the traverse strokes H may lie very closely to each other, and the distance B is only as great as is needed for the build of a waste winding and a transfer tail on one end of each of the abutting bobbins. It should also be noted that the bobbins need not be mounted on a single support spindle as illustrated, and the invention may also be used where a number of bobbins are rotatably mounted on a corresponding number of bobbin receiving spindles in such a way that during the winding process the bobbins are substantially in alignment with and placed closely adjacent to each other so that the traversing assemblies overlap.

Figure 8:
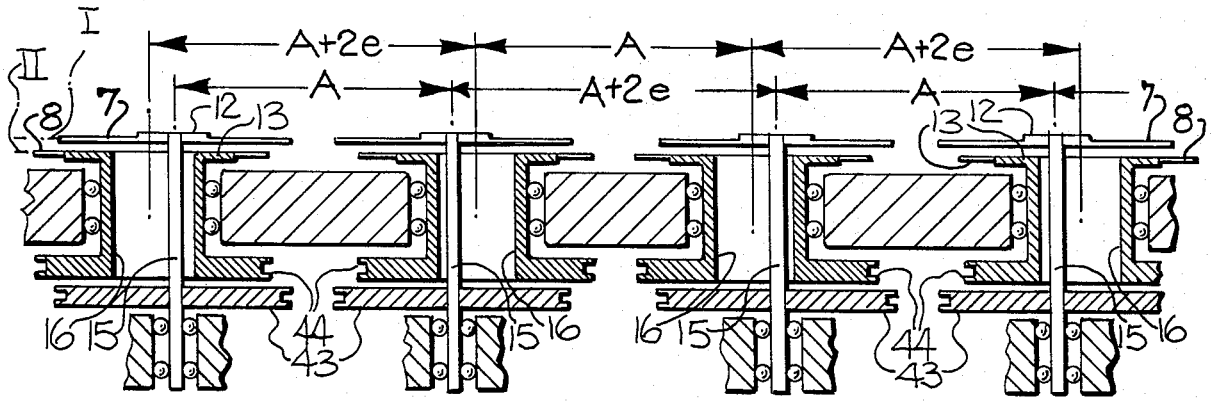
FIG. 8 is a view similar to FIG. 4, but illustrating a further embodiment of the drive system of the apparatus.
Figure 9:
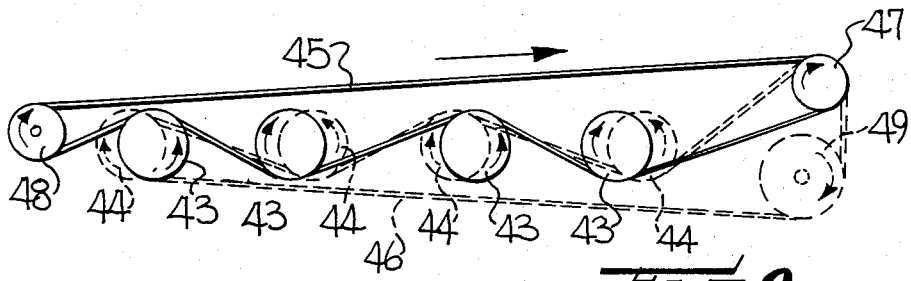
FIG. 9 is a schematic top plan view illustrating a further embodiment of a drive system for the traversing assemblies in accordance with the present invention.

FIGS. 8 and 9 illustrate an embodiment wherein tangential belts are employed for driving the rotors 12 and 13. FIG. 8 is similar to FIG. 4, with the only difference being that the worm gear wheels 17 and 19 of FIG. 4 are replaced in FIG. 8 by pulleys 43 and 44. In addition, FIG. 8 shows a drive arrangement which is positioned on one side only of the planes of rotation, which is also true for the embodiment shown in FIG. 10.

FIG. 9 shows a top plan view of the pulleys 43 and 44. This figure also illustrates that the axial distances of the rotors, and of the pulleys 43, 44, alternately vary from traverse stroke to traverse stroke. The pulleys 43 are driven by the tangential belt 45, with each of the pulleys being looped by the belt at a predetermined angle. The belt 45 passes the pulleys 43 in a zag-zag manner, and the belt is preferably a toothed belt having each side provided with teeth. The pulleys 44 are driven by the tangential belt 46, and the numeral 47 indicates a common drive pulley which may be directly driven by a motor (not shown) or by means of a gear or belt drive. An idler pulley 48 serves to guide the belt 45, and a further idler pulley 49 serves to guide the belt 46.

Figure 10:
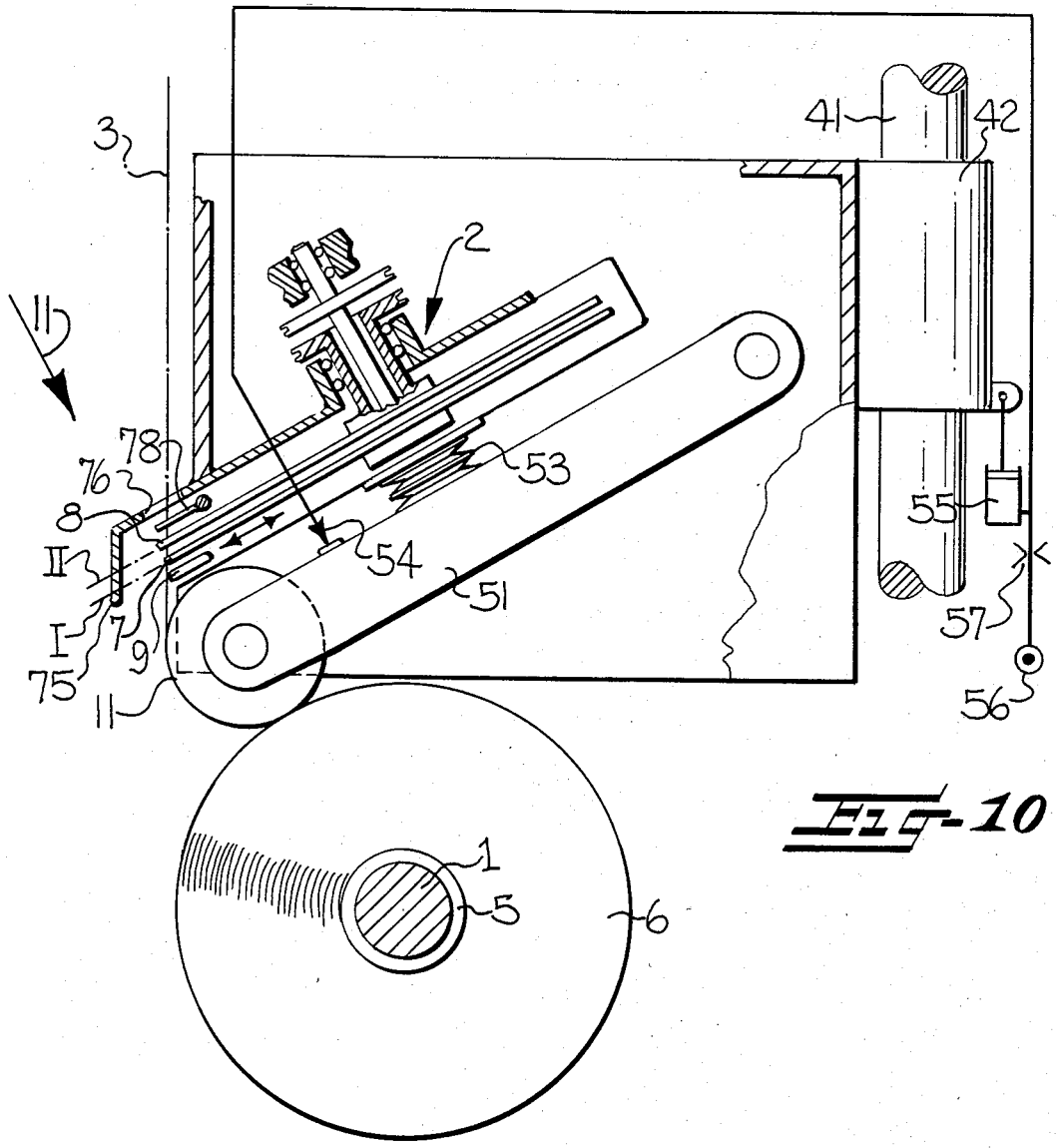
FIG. 10 is an end sectional view of a further embodiment of the invention.

In the embodiment of FIG. 10, the carriage 42 is slideably mounted on the support bar 41 so that the carriage may be moved relative to the packages 6. In addition, the carriage 42 mounts the traversing assemblies according to the present invention, and it also mounts the guide rolls 11 which are mounted on pivot arms 51. The pivot arms 51 are held in position by a spring biasing member, which may for example comprise a set of disc springs 53 which are held under pressure. The guide rolls 11 are thus biased into contact with the packages by the springs 53.

The position of the pivot arm 51 relative to the carriage 42 may be monitored, for example, by a nozzle and deflecting plate system 54. This system produces an output signal which is delivered to the drive means of the carriage 42, with the drive means being schematically illustrated by the cylinder and piston unit 55. The cylinder and piston unit 55 receives a pressure from a pressure source 56 via throttle 57, and the pressure prevailing behind the throttle 57 thus depends on the gap width at the nozzle 54.

The guide roll 11 of the embodiments of FIGS. 2, 7, and 10 may also serve as a drive roll, or as a control roll. Where the guide roll is used as a control roll, its speed is continuously monitored, and the monitored value is transmitted to a drive motor which directly drives the support spindle, so that the circumferential speed of the package 6 remains constant while its diameter is increasing.

Figure 11:
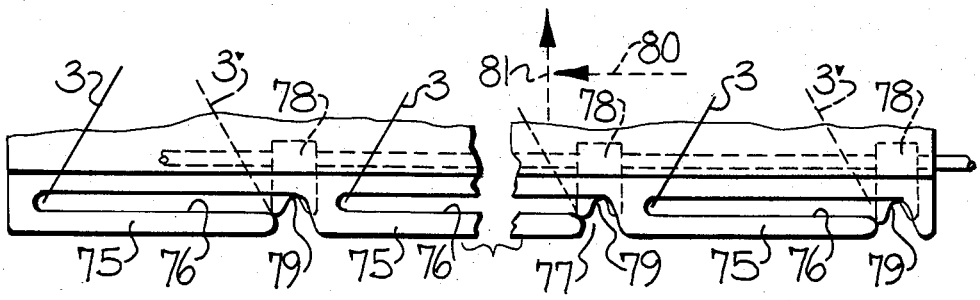
FIG. 11 is a top plan view of the protective cover plate and taken in the direction of the arrow 11 in FIG. 10.

Although the arrangement of the gears is necessarily complicated due to the multiple winding stations, the present invention permits the uniform traversing of the yarns of all winding stations, i.e., all yarns are reciprocated in unison and in the same direction. This fact permits considerable advantages for the build of uniform packages and for the simultaneous application of the yarns when the apparatus is put into operation. FIG. 11 schematically represents the instantaneous view of the reciprocating yarns 3 of the several traverse strokes, with the yarn being shown in solid lines at 3 at one end of the stroke and in dashed lines 3' at the other end of the stroke.

FIG. 11 also illustrates an embodiment of a housing for the traversing assemblies shown in FIG. 10. As shown in these two figures, each traverse stroke is covered by a protective cover plate 75 which extends along the front of the machine. This protective plate 75 covers the planes of rotation I and II and extends downwardly in the direction of the yarn path. This arrangement prevents the operator from coming into contact with the rotating arms, and in addition from getting a yarn suction pistol or the like into the circles of rotation of the arms when inserting the yarn, and which could otherwise damage the arms and their phase relationships. Each protective plate 75 includes a yarn guide slot 76 which is vertically aligned with the guide bar 9, note FIG. 10. The slot 76 is closed at one end, but includes a yarn inserting opening 77 at the other end and so as to communicate with the guide notch 79 of the transfer means 78 which is adapted to form the transfer tail. After a yarn has been inserted into the transfer means 78, the transfer means 78 slowly moves to the center of the traverse stroke in the direction indicated by arrow 80, and in doing so, a transfer tail consisting of several yarn windings is formed on the bobbin outside the normal zone of the traverse stroke. The transfer means 78 then withdraws from the yarn path in the direction of arrow 81, and as a result, the released yarn moves toward the center of the traverse stroke. During this movement, the yarn is caught by the arms of the traversing assembly.

Figure 12:
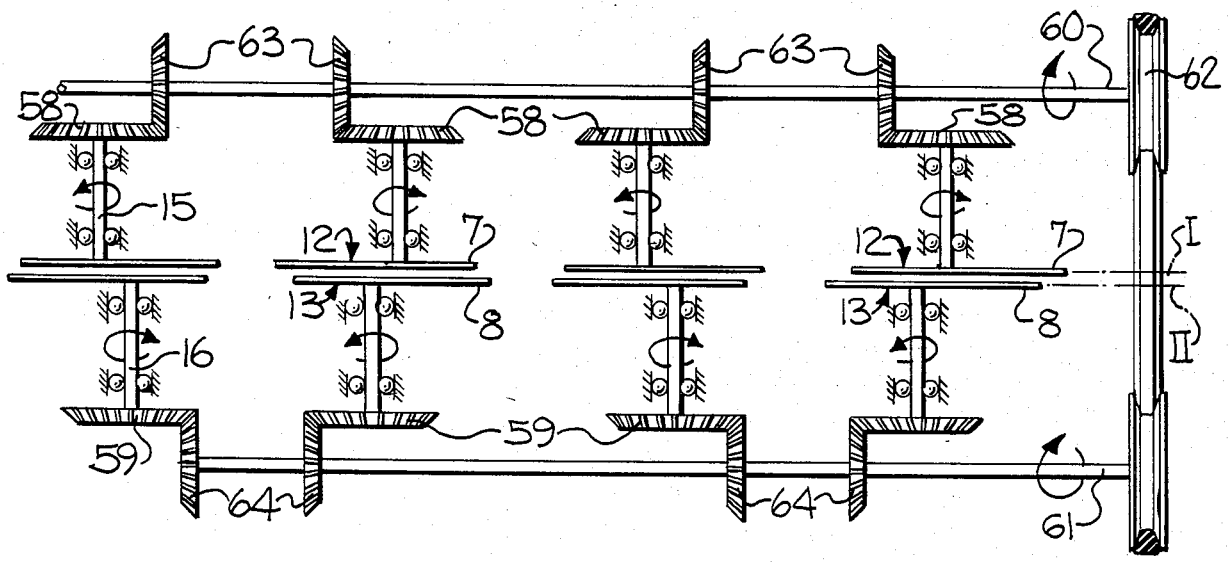
FIG. 12 is a top plan view illustrating still another embodiment of a drive system for the traversing assemblies in accordance with the present invention.

FIG. 12 illustrates an embodiment wherein the drive shafts 15, 16 of the rotors 12 and 13 are disposed on opposite sides of the planes of rotation. Each drive shaft 15, 16 mounts a bevel gear 58, 59, respectively, and these bevel gears are in turn driven by the bevel gears 63, 64 on the drive rods 60, 61 which extend along several traversing assemblies and are driven by the belt drive 62. The shafts 60, 61 thus rotate in the same direction, and the bevel gears 63, 64 serve to transfer the torque of the shafts 60, 61 to the bevel gears 58, 59 and thus the rotors 12, 13. Also, the bevel gears 63 alternately engage the left side and the right side of the bevel gears 58 of the rotors 12, and the same arrangement applies to the bevel gears 64 on the shaft 61, to thereby impart the desired directions of rotation to the rotors.

Figure 13:
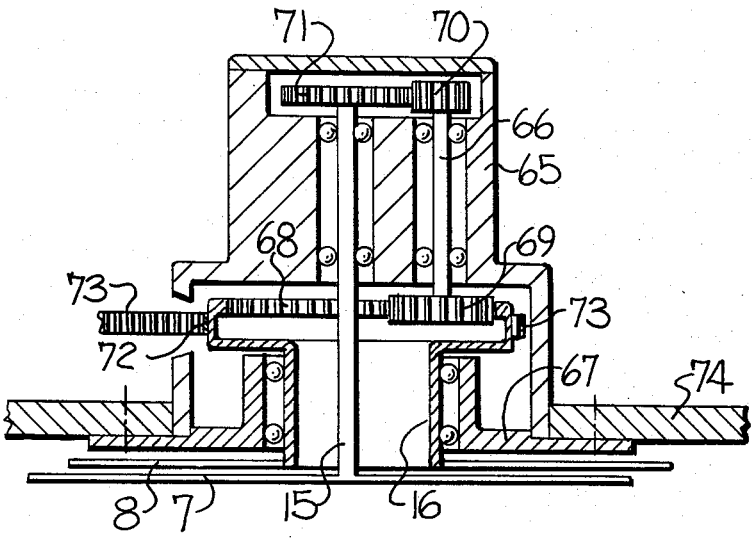
FIG. 13 is a sectional elevation view of a casing for mounting a pair of rotors of a traversing assembly.
Figure 13:
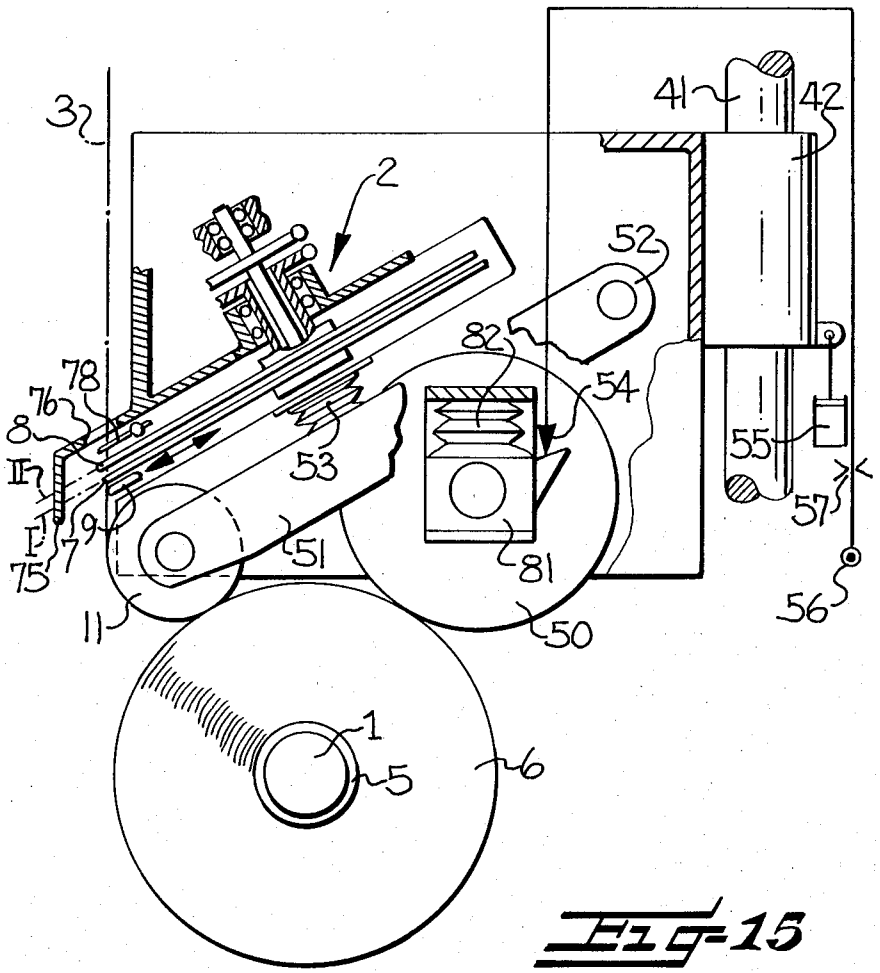
Figure 14:
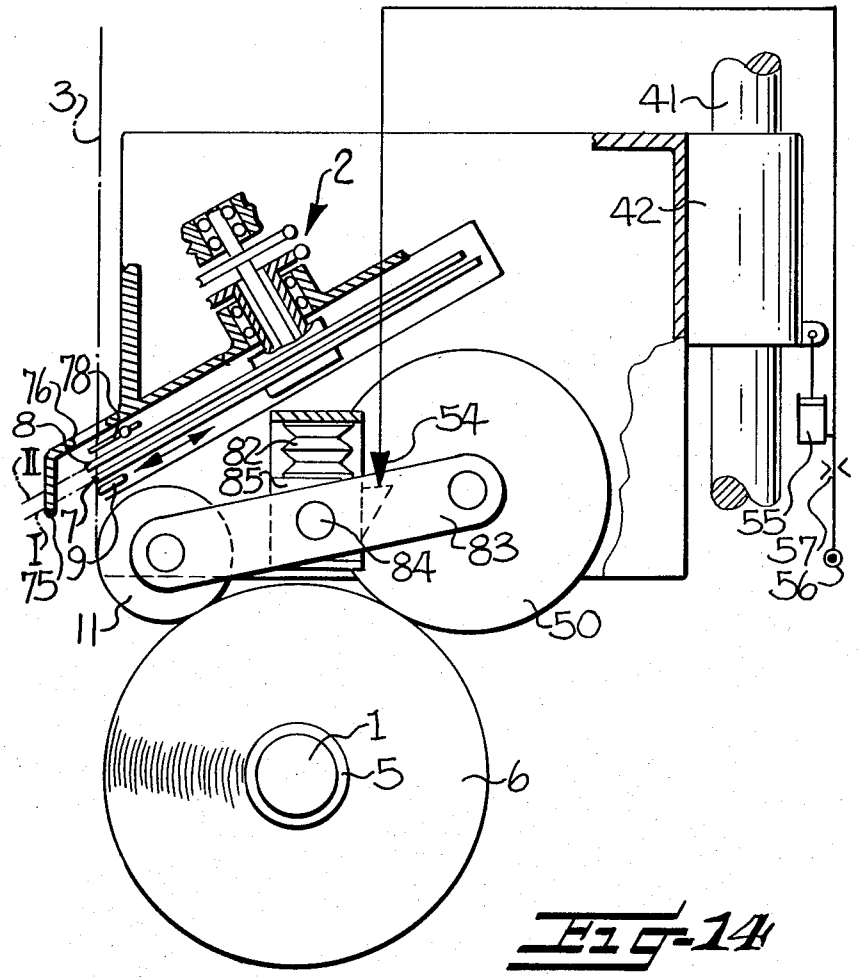

In the embodiment of FIG. 13, there is provided a casing 65 for the shafts 15 and 16, and which in plan view has an oval shape, with the primary axis extending in the direction of eccentricity between the shaft 15 and shaft 16. The shaft 15 for the rotor 12 is rotatably mounted in the casing 65, and the casing cover 67 rotatably mounts the tubular shaft 16 of the rotor 13. During assembly of the casing, the cover 67 and the casing 65 are fixedly connected to each other by bolts or the like (not shown). The tubular shaft 16 is provided with an internal gear 68, and the outside surface of the shaft 16 includes an external gear 72 for engagement with a toothed wheel or toothed belt. As illustrated, the tubular shaft 16 is driven by a belt 73, with the casing 65 being provided with appropriate recesses to permit the belt to pass therethrough. The rotational movement of the tubular shaft 16 is transmitted to the shaft 15 via the transmission shaft 66, which is also rotatably mounted in the casing 65. More particularly, the transmission shaft 66 includes a gear 69 operatively engaging the internal gears 68 of the shaft 16, and a gear 70 cooperating with the mating gear 71 on the shaft 15. By providing for the proper engagement of the gears during assembly of the casing, the casing may be preassembled such that the phase relationship of the blades 7 and 8 is set in such a manner that an exact transfer of the yarn at the stroke reversal points is insured. The preassembled casing 65 may be installed in the machine frame 74, which comprises a part of the housing of the traversing assemblies. After assembling the casing 65 to the frame 74, the phase relationship of the rotors of adjacent assemblies may be set in accordance with the present invention, by interconnecting the external gear 72 with the associated gear or belt 73.

Figure 14:
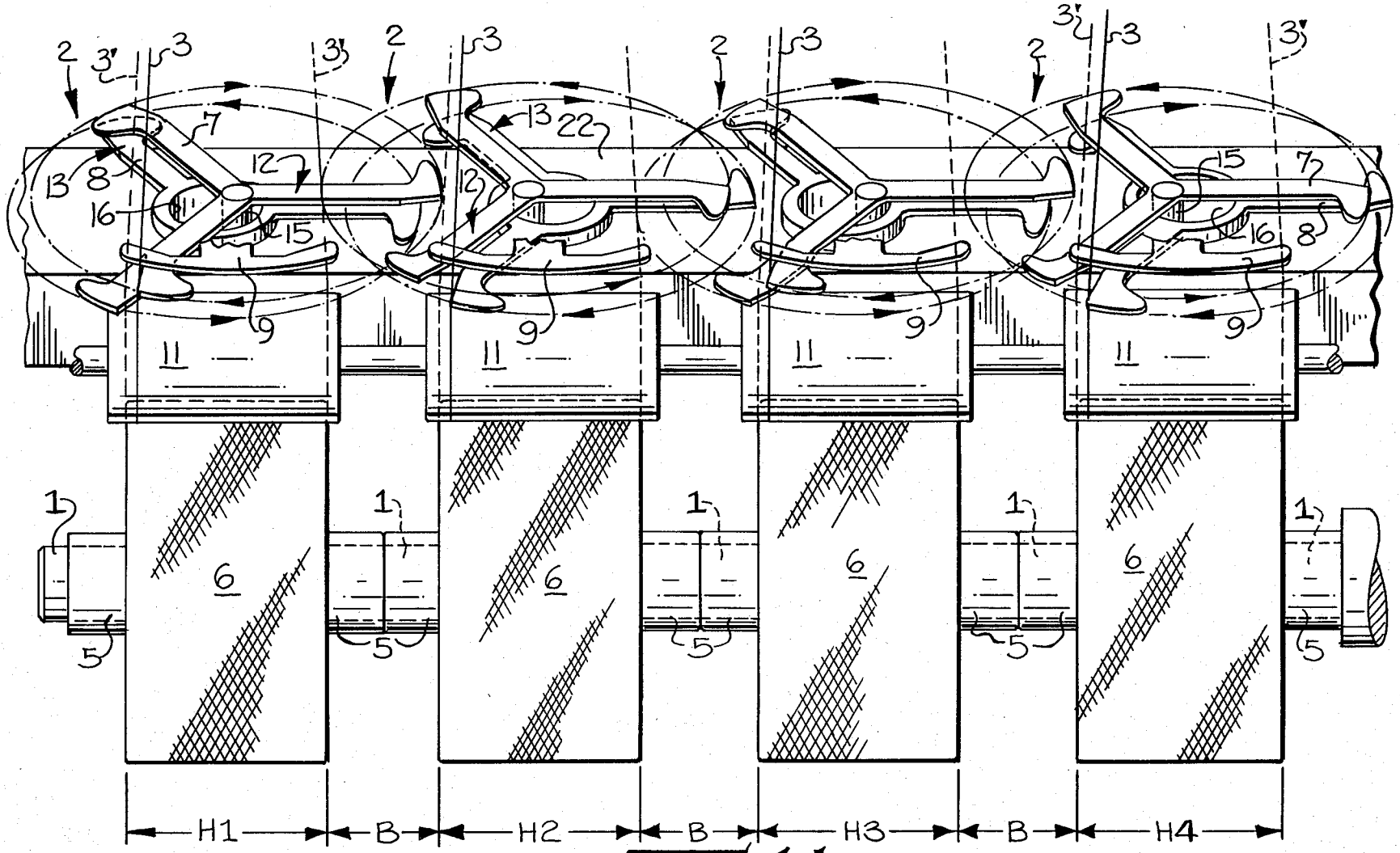

FIGS. 14 and 15 illustrate embodiments which are generally similar to the embodiment of FIG. 10. However, these embodiments comprise a drive roll 50, with the roll 50 being movable with respect to the mounting carriage 42. For this purpose, a bearing body 81 is slideably mounted to the carriage 42 by an arrangement which includes the disc springs 82. The nozzle 54 of the nozzle and deflecting plate system is fixed to the carriage, and the nozzle monitors the movements performed by the body 81 with respect to the carriage 42. The pressure prevailing in the cylinder and piston unit 55 is thereby controlled such that as the diameter of the package builds, the distance between the nozzle and the deflecting plate is reduced and the pressure in the supporting system thus becomes increased. The increased pressure causes the carriage 42 to move upwardly until a balance of pressure is re-established.

Referring again to FIG. 14, the guide roll 11 and the drive roll 50 are mounted on a common pivoting support 83. The support 83 pivots about the pin 84, and the axis of the pin 84 is mounted in a bearing body 85 which is able to move in a guide way relative to the carriage and against the disc springs 82. The relative movement performed by the bearing body 85 in turn is monitored by the nozzle and deflecting plate system 54 and transmitted to the cylinder and piston unit 55 as described above.

Figure 16:
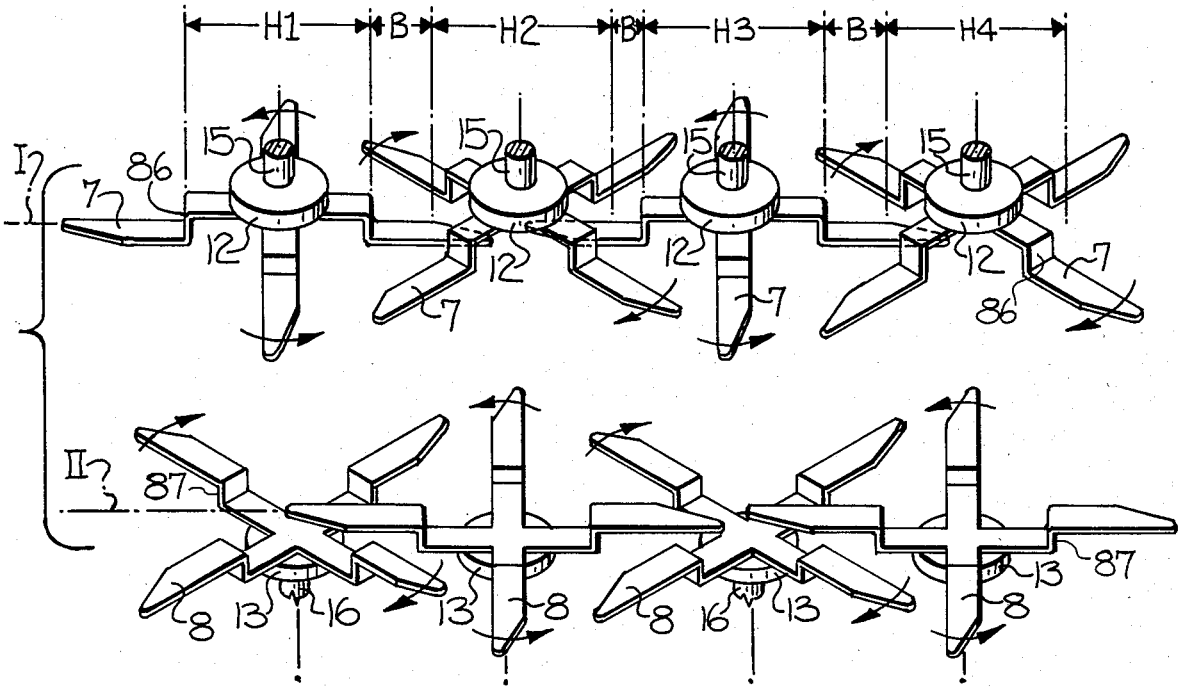
FIG. 16 is an exploded perspective view of a further embodiment for the rotors of the traversing assemblies.
Figure 17:
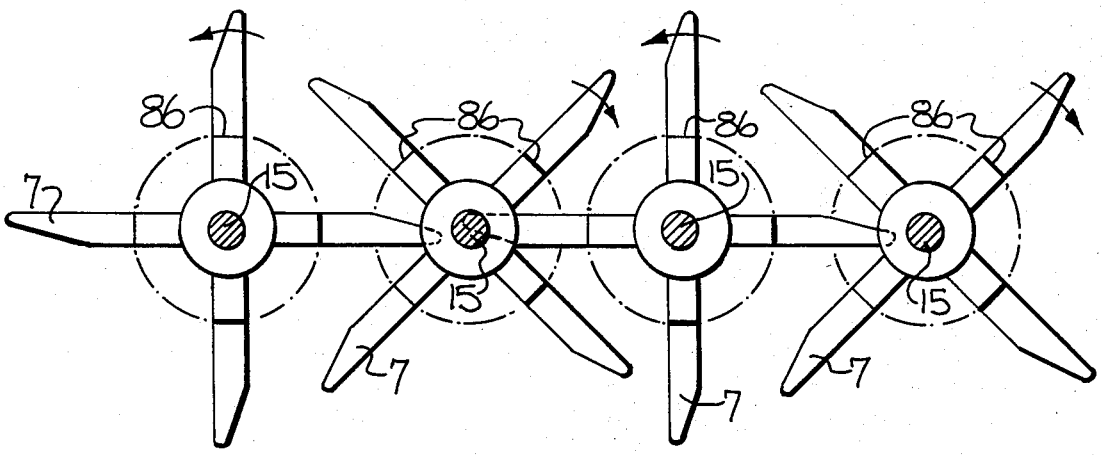
FIG. 17 is a top plan view of one corresponding set of rotors of the embodiment illustrated in FIG. 16.

The embodiments of FIGS. 16 and 17 represent rotors 12 and 13 which are suited to produce packages having a length of 100 mm or less, for example 85 mm.

For properly mounting the gears, rotors with four blades 7 or 8 are used in each plane of rotation I, II. In order to place the traverse strokes H1, H2, H3, etc. side by side at the smallest possible distance B, the ends of the arms 7 of rotors 12 are laterally offset, as can be seen at 86 in FIG. 16, and the ends of the arms 8 of rotors 13 are laterally offset at 87. Thus only the outer ends of the blades 7 lie in the plane of rotation I and only the outer ends of blades 8 lie in the plane of rotation II.

It will also be noted that the arms 7 and 8 of the embodiment of FIGS. 16 and 17 are designed to be sufficiently long that their circles of rotation, at least in the case of the smaller axial distance with respect to the adjacent assembly, overlap the axis of rotation of the adjacent rotor. The arms may also be longer than the sum of the stroke H and distance B between the strokes. For this purpose, the arms 7 or 8 of one plane of rotation mesh like toothed wheels, as described above with reference to FIG. 1, with offset ends of the arms 7 of each traversing assembly overlapping the offset ends of the arms 7 of adjacent assemblies. The same relationship applies to the arms 8 which overlap the offset ends of the adjacent arms 8 in the overlap area of the circles of rotation.

A significant feature of the embodiment of FIG. 16 resides in the fact that the drive gears (not shown) of the rotors in the planes of rotation I or II of which only the shafts 15 or 16 are illustrated, are separated. The gear units are thus arranged on respectively opposite sides of the planes of rotation, and in this regard, the arrangement corresponds for example to that shown in FIG. 7.

The above described structure with respect to FIGS. 16 and 17 permits the drive means and gear units to be properly dimensioned, and to clearly arrange the drive units and gear units to provide small stroke length with very small separating distances. For example, the illustrated traversing assemblies permit the simultaneous winding of 8 yarns into 8 packages of a length of 84 mm each, with the bobbins being mounted on a single spindle having a length of 900 mm.

Viewing the embodiments of FIGS. 1–15, it will be noted that the outer extremity of each arm of each rotor includes a leading edge 90 (note FIG. 1) facing in the direction of its rotation and which is adapted to contact and move the running yarn toward the end of the traverse stroke, and a trailing edge 91 which extends from the outermost tip of the arm and is slightly convexly curved along its length. The curvature of the trailing edge 91 is configured to cooperate with the guide bar 9 in engaging the yarn after the yarn has reached the end of the traverse stroke and so as to permit the yarn to move along the trailing edge and guide bar from the end of the traverse stroke toward the center thereof at a controlled speed. A further description of this feature of the invention is described in the copending application of Herbert Turk, Ser. No. 445,285.

In the drawings and specification, there has been set forth a preferred embodiment of the invention, and although specific terms are employed, they are used in a generic and descriptive sense only and not for purposes of limitation.

That which is claimed is:

1. A winding apparatus for winding a plurality of running yarns to form a corresponding number of yarn packages, and comprising bobbin support means for mounting a plurality of tubular bobbins in a coaxial arrangement, and yarn traverse means for reciprocating the running yarns along respective aligned traverse strokes and so as to form a wound yarn package on each bobbin, the improvement wherein said yarn traverse means comprises a plurality of traversing assemblies disposed in a closely spaced apart arrangement extending along said bobbin support means so as to permit the bobbins to be disposed closely adjacent to each other on said support means, with each traversing assembly being adapted to reciprocate a running yarn onto a rotating bobbin mounted on said support means, and with each traversing assembly comprising (a) a yarn guide bar mounted to extend in a direction generally parallel to the axis of said bobbin support means, (b) a first rotor having at least two coplanar radial arms and mounted for rotation about a first axis such that the extremities of the rotating arms pass along said yarn guide and define a first plane, (c) a second rotor having at least two coplanar radial arms and mounted for rotation about a second axis such that the extremities of the rotating arms pass along said yarn guide and define a second plane, and with said first axis being parallel to and offset from said second axis in a direction generally parallel to the axis of said bobbin support means, and with the first and second planes being parallel to and closely adjacent each other, said traversing assemblies being mounted adjacent to each other such that each traversing assembly has its first axis offset from its second axis in a direction which is opposite to the direction of offset in each immediately adjacent traversing assembly, and such that said first and second planes of said assemblies are respectively coincident, and further such that the extremities of the rotor arms of adjacent traversing assemblies define circles upon rotation thereof which overlap in at least one of said first and second planes, and drive means for rotating the rotors of each traversing assembly in opposite directions with respect to each other, and for rotating the rotors of adjacent traversing assemblies such that the first rotors thereof rotate in opposite directions with respect to each other and the second rotors thereof rotate in opposite directions with respect to each other.

2. The winding apparatus as defined in claim 1 wherein the offset distance by which the first axis is offset from the second axis is essentially the same for each of said traversing assemblies, and the distance between the two first rotors of adjacent assemblies differs from the distance between the two second rotors of the same adjacent assemblies by twice said offset distance.

3. The winding apparatus as defined in claim 2 wherein said extremities of the rotor arms of adjacent traversing assemblies which define circles upon rotation thereof define circles which overlap in both of said first and second planes.

4. The winding apparatus as defined in claim 3 wherein each rotor of each traversing assembly includes three of said arms which are equally spaced from each other by 120 degrees, and said drive means includes gear means interconnecting the rotor arms of adjacent traversing assemblies which are in a common plane so that the extremities thereof move through the overlapping area in the manner of meshing gear wheels but without contact.

5. The winding apparatus as defined in claim 4 wherein the outer extremity of each of said arms of each rotor includes a leading edge facing in the direction of its rotation and which is adapted to contact and move the running yarn toward one end of the traverse stroke, and a trailing edge configured to cooperate with said yarn guide bar in engaging the yarn after the yarn has reached said one end of the traverse stroke and so as to permit the yarn to move along the trailing edge and guide bar from said one end of the traverse stroke toward the center thereof at a controlled speed.

6. The winding apparatus as defined in claim 4 wherein said first and second rotors of each traversing assembly are disposed on one side of the plane of the yarn traverse stroke, and said yarn guide bar of each traversing assembly is disposed on the same side of the plane of the yarn traverse stroke.

7. The winding apparatus as defined in claim 6 further comprising means mounting said guide bar to permit withdrawal thereof in a direction extending away from said rotor axes.

8. The yarn winding apparatus as defined in claim 7 wherein said yarn guide bar of each traversing assembly includes a yarn catching notch at each of the ends thereof and at a location outside of the normal yarn traverse stroke.

9. The winding apparatus as defined in claim 6 further comprising a protective cover plate positioned to overlie each yarn guide bar of each traversing assembly, with said cover plate including a plurality of slots each generally aligned with one of said guide bars in the direction of the running yarn for receiving the yarn therethrough.

10. The winding apparatus as defined in claim 9 further comprising means disposed immediately adjacent each of said slots in said protective cover plate for forming a transfer tail on the bobbin of the associated wound yarn package.

11. The winding apparatus as defined in claim 4 wherein the reciprocating running yarns define a running plane, and wherein said first and second planes of said traversing assemblies are disposed at an angle of between about 45 degrees to 70 degrees with respect to said running plane.

12. The winding apparatus as defined in claim 1 wherein said first rotor of each traversing assembly includes a first shaft extending along said first axis, and said second rotor of each traversing assembly includes a second shaft extending coaxially along said second axis.

13. The winding apparatus as defined in claim 12 wherein said second shaft is tubular, and said first shaft extends therethrough.

14. The winding apparatus as defined in claim 13 wherein said first and second shafts of the rotors of each traversing assembly are disposed on the side of said first and second planes which is opposite said bobbin support means.

15. The winding apparatus as defined in claim 13 further comprising drive roller means adapted to contact the surface of each of the yarn packages being wound on said bobbin support means.

16. The winding apparatus as defined in claim 13 wherein said first and second shafts of each of said traversing assemblies are disposed on the side of the first and second planes of rotation which is adjacent said bobbin support means.

17. The winding apparatus as defined in claim 13 wherein said drive means includes gear means operatively engaging the surface of said tubular second shaft, and transmission means interconnecting said tubular second shaft with said first shaft so that the two shafts rotate at the same speed but in opposite directions.

18. The winding apparatus as defined in claim 17 wherein said first shaft, said tubular second shaft, and said transmission means of each traversing assembly are all mounted in a common casing, with said casing having an opening communicating with said tubular second shaft for permitting operative passage of said gear means.

19. The winding apparatus as defined in claim 12 wherein said first and second shafts are disposed on opposite sides of said planes of rotation.

20. The winding apparatus as defined in claim 19 further comprising a first housing component rotatably supporting said first shaft, a second housing component rotatably supporting said second shaft, and hinge means pivotally interconnecting said first and second housing components so as to permit the separation thereof.

21. The winding apparatus as defined in claim 12 wherein said drive means comprises a first drive rod extending along the length of said traversing assemblies and operatively engaging each of said first rotors, and a second drive rod extending along the length of said traversing assemblies and operatively engaging each of said second rotors.

22. The winding apparatus as defined in claim 21 wherein said drive means further comprises a worm gear wheel coaxially mounted to each of said first and second shafts of each of said traversing assemblies, a plurality of worm gears mounted on said first drive rod and operatively engaging respective worm gear wheels of said first shafts, a plurality of worm gears mounted on said second drive rod and operatively engaging respective worm gear wheels of said second shafts, and with the worm gears being alternately lefthanded and righthanded along each of said first and second drive rods.

23. The winding apparatus as defined in claim 21 wherein said drive means further includes a bevel gear coaxially mounted to each of said first and second shafts of each of said traversing assemblies, a plurality of bevel gears mounted on said first drive rod and operatively engaging respective bevel gears on said first shafts, a plurality of bevel gears mounted on said second drive rod and operatively engaging respective bevel gears of said second shafts, and with the bevel gears along each of said first and second drive rods being alternately oriented.

24. The winding apparatus as defined in claim 12 wherein said drive means further comprises a pulley mounted to each of said first and second shafts, and drive belt means operatively engaging each of said pulleys.

25. The winding apparatus as defined in claim 4 wherein each of said yarn guide bars includes a continuous inner guide rail adapted to contact and guide the running yarn, and an outer guide rail extending generally parallel to and spaced from said inner guide rail along each end portion thereof to thereby provide opposing yarn guide edges along each end portion.

26. The winding apparatus as defined in claim 4 wherein each of said yarn guide bars includes a continuous guide rail adapted to contact and guide the running yarn, with said guide rail being curved in a direction such that the traversing speed is greater at each of the end portions of the traverse stroke than the average traverse speed by about 1 to 4%.

27. The winding apparatus as defined in claim 11 wherein each of said traversing assemblies further comprises a guide roll mounted for rotation about an axis parallel to said bobbin support means, and at a location such that the running yarn is adapted to partially loop about said guide roll prior to being wound onto a bobbin.

28. The winding apparatus as defined in claim 27 wherein each of said traversing assemblies further comprises a carriage mounted for movement in a direction generally perpendicular to the axis of said bobbin support means, and means mounting said guide roll to said carriage so as to be biased into contact with the package being wound thereupon.

29. The winding apparatus as defined in claim 28 further comprising control means for monitoring the size of the package being wound, and means responsive to said control means for moving said carriage in response to the build of the package.

30. The winding apparatus as defined in claim 29 wherein said drive means further comprises a drive roll mounted to each of said carriages for contacting the surface of the package being wound, with said guide roll and associated drive roll being mounted on a common support which is pivotally connected to said carriage.

31. The winding apparatus as defined in claim 2 wherein each of said rotors of each traversing assembly has four arms which are equally spaced apart by 90 degrees, and wherein the radial length of said arms is greater than the smallest axial distance between corresponding axes of rotation of adjacent assemblies.

32. The winding apparatus as defined in claim 31 wherein each of said arms of each rotor is laterally offset in such a manner that only the remote end portions thereof lie in the associated plane of rotation.

33. The winding apparatus as defined in claim 32 wherein said first rotor of each traversing assembly includes a first shaft extending along said first axis, and said second rotor of each traversing assembly includes a second shaft extending along said second axis, and wherein said first and second shafts are disposed on opposite sides of said planes of rotation.

34. A winding apparatus for winding a plurality of running yarns to form a corresponding number of yarn packages, and comprising bobbin support means for mounting a plurality of tubular bobbins in a coaxial arrangement, and yarn traverse means for reciprocating the running yarns along respective aligned traverse strokes and so as to form a wound yarn package on each bobbin, the improvement wherein said yarn traverse means comprises a plurality of traversing assemblies disposed in a closely spaced apart arrangement extending along said bobbin support means so as to permit the bobbins to be disposed closely adjacent to each other on said support means, with each traversing assembly being adapted to reciprocate a running yarn onto a rotating bobbin mounted on said support means, and with each traversing assembly comprising (a) a yarn guide bar mounted to extend in a direction generally parallel to the axis of said bobbin support means, (b) a first rotor having at least two coplanar radial arms and mounted for rotation about a first axis such that the extremities of the rotating arms pass along said yarn guide and define a first plane, (c) a second rotor having at least two coplanar radial arms and mounted for rotation about a second axis such that the extremities of the rotating arms pass along said yarn guide and define a second plane, and with said first axis being parallel to and offset from said second axis in a direction generally parallel to the axis of said bobbin support means, and with the first and second planes being parallel to and closely adjacent each other, said traversing assemblies being mounted adjacent to each other such that said first and second planes of said assemblies are respectively coincident, and further such that the extremities of the rotor arms of adjacent traversing assemblies define circles upon rotation thereof which overlap in said first and second planes, and drive means for rotating the rotors of each traversing assembly in opposite directions with respect to each other, and for rotating the rotors of adjacent traversing assemblies such that the first rotors thereof rotate in opposite directions with respect to each other and the second rotors thereof rotate in opposite directions with respect to each other, so that the rotor arms of adjacent traversing assemblies which are in a common plane move through the overlapping area in the manner of meshing gear wheels but without contact.

35. The winding apparatus as defined in claim 34 wherein said first rotor of each traversing assembly includes a first shaft extending along said first axis, and said second rotor of each traversing assembly includes a second shaft extending coaxially along said second axis, with said second shaft being tubular and having said first shaft extending therethrough.

36. The winding apparatus as defined in claim 35 wherein said drive means includes transmission means interconnecting said tubular second shaft with said first shaft so that the two shafts rotate at the same speed but in opposite directions.

37. The winding apparatus as defined in claim 36 wherein said first shaft, said tubular second shaft, and said transmission means of each traversing assembly are all mounted in a common casing.

38. The winding apparatus as defined in claim 37 wherein said drive means further includes gear means extending through an opening in said common casing of each traversing assembly and operatively engaging one of said first and second shafts.

39. The winding apparatus as defined in claim 34 wherein each rotor of each traversing assembly includes three of said arms which are equally spaced apart from each other by 120 degrees.

* * * * *